United States Patent [19]

Hunter

[11] Patent Number: 4,579,285

[45] Date of Patent: Apr. 1, 1986

[54] ADJUSTABLE SPRINKLER SYSTEM

[76] Inventor: Edwin J. Hunter, 5551 Codorniz Rd., Rancho Santa Fe, Calif. 92067

[21] Appl. No.: 601,944

[22] Filed: Apr. 19, 1984

[51] Int. Cl.[4] ..... B05B 1/32

[52] U.S. Cl. ..... 239/457; 239/538; 239/DIG. 1

[58] Field of Search ..... 239/451–457, 239/563, DIG. 1, 436, 437, 537, 538, 390, 394, 539; 222/553

[56] References Cited

U.S. PATENT DOCUMENTS

| | | | |
|---|---|---|---|
| 1,417,031 | 5/1922 | Casorso et al. | 239/394 |
| 2,321,031 | 6/1943 | Lateur | 222/553 |
| 2,935,266 | 5/1960 | Coleondro | 239/DIG. 1 |
| 3,362,641 | 1/1968 | Barnes | 239/DIG. 1 |
| 3,815,832 | 6/1974 | Floyd | 239/563 |
| 4,079,762 | 3/1978 | Hanson | 239/453 X |
| 4,154,404 | 5/1979 | Clawson | 239/563 |

*Primary Examiner*—Joseph F. Peters, Jr.
*Assistant Examiner*—Michael J. Forman
*Attorney, Agent, or Firm*—Baker, Maxham & Jester

[57] ABSTRACT

An adjustable orifice sprinkler unit includes a tubular body member with a rotatable cap mounted on one end thereof that cooperates with peripheral edges of the tubular body member for defining an adjustable arc spray orifice for adjusting a spray pattern from an angle of from about 0 degrees up to about 360 degrees with the cap adjustable axially of the tubular body member for selectively adjusting the height of the orifice opening.

18 Claims, 5 Drawing Figures

ADJUSTABLE SPRINKLER SYSTEM

BACKGROUND OF THE INVENTION

The present invention relates to sprinkler units and pertains particularly to an improved sprinkler unit having an adjustable orifice for adjusting the arc of coverage around the sprinkler unit.

Sprinkler units are quite extensively used for the application of water to lawns and agricultural plants. Many forms of sprinkler units are available which provide various degrees of coverage of particular areas. Typically sprinkler units are constructed to provide a fan-type pattern of spray out from the sprinkler unit. The pattern typically covers various segments of a circle and sprinkler heads are specifically constructed to provide the particular angle of coverage.

This prior art approach, however, requires that a different sprinkler head be constructed for each spray pattern. This is expensive not only in requiring a separate production line for each sprinkler head but also requiring maintenance of inventory and shipment of different heads for each requirement.

It is therefore desirable that a single sprinkler head unit be available that is selectively adjustable to provide a selective area of coverage as well as an adjustable flow rate.

SUMMARY AND OBJECTS OF THE INVENTION

It is the primary object of the present invention to provide an improved adjustable coverage sprinkler unit.

In accordance with the primary aspect of the present invention, an adjustable area sprinkler unit for covering a selected area of from approximately 0 to approximately 360 degrees of coverage includes a main tubular body member with a rotatable member mounted thereon for defining a variable angle arcuate orifice.

BRIEF DESCRIPTION OF THE DRAWINGS

The above and other objects and advantages of the present invention will be apparent from the following description when read in conjunction with the drawings wherein.

DETAILED DESCRIPTION OF THE PREFERRED EMBODIMENT

Figure 1:
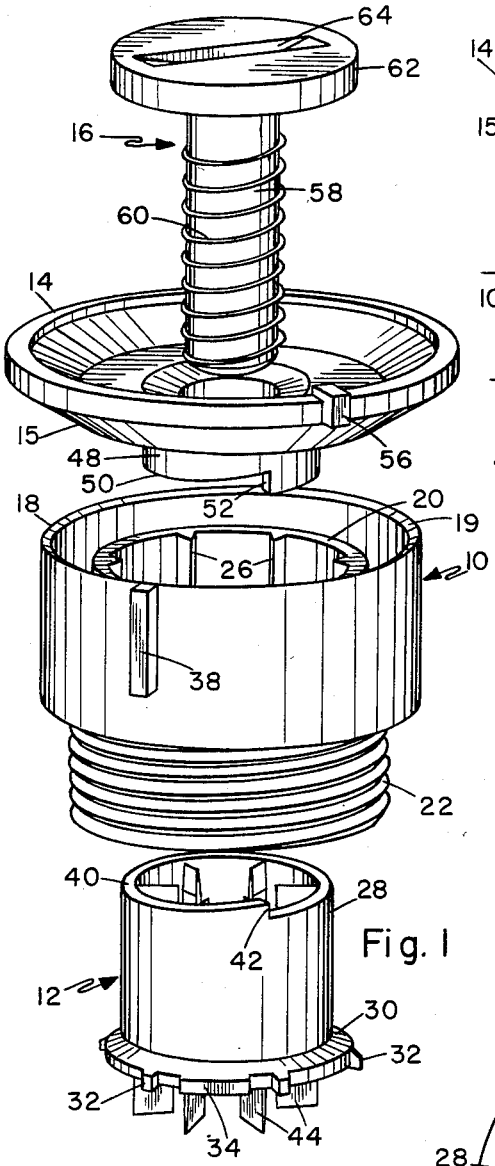
FIG. 1 is an exploded perspective view of the spray head components.

Referring to the drawings, a sprinkler unit constructed in accordance with a preferred embodiment the invention is illustrated. With particular reference to FIG. 1, the preferred embodiment comprises four main components comprising of an outer main body unit 10 and an inner tubular body member 12 which fits within a bore in the outer body member 10, a rotatable cap member 14, which rotatably mounts on the end of the inner tubular body member, and a screw member 16 for retaining the components in the assembled position.

Figure 2:
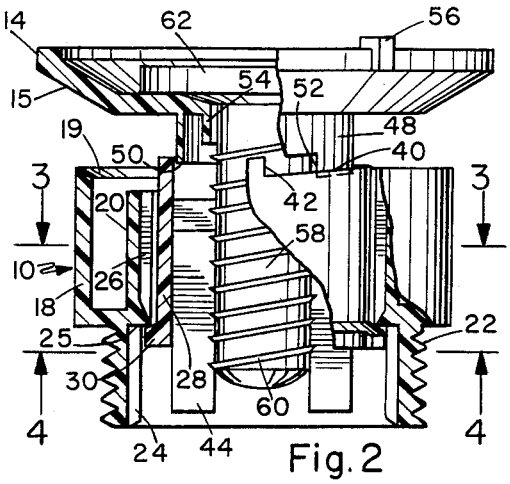
FIG. 2 is a side elevation view, with portions cut away, of the assembled spray head.

The main body member 10 is of a generally cylindrical tubular configuration defined by an outer circular wall 18 with an upper edge 19 and an inner circular wall 20 and a threaded skirt portion 22 defining a coupling or connector member for attachment to a riser for supply of pressurized water. A generally stepped cylindrical through bore is provided in the housing member 10 by the interior diameter of the lower wall 22 and the interior diameter of the inner wall 20 which is slightly less than that of 22 and extending generally coaxial. As best seen in FIG. 2, the lower or inner surface of wall 22 is provided with a plurality of inwardly directed ribs or splines 24 spaced annularly around the interior thereof for purposes as will explained. The inner wall or interior surface of the wall 20 similarly includes a plurality of inwardly directed ribs 26.

The inner tubular body member 12 is of a generally circular cylinder configuration having a generally cylindrical wall 28 having a radially outwardly extending lower flange 30 having radially extending ribs 32 for extending into grooves between the ribs 24 in the lower tubular portion 22 of the housing 10. A locating rib 34 cooperates with a locating slot 36 formed in the interior wall of the lower tubular portion 22 of the housing 10 for angularly locating the tubular body member 28 relative to an external indicia mark 38 on the exterior of the housing or body member 10. The cylindrical wall 28 of the tubular member 12 terminates at its upper or outlet end in a peripheral edge 40 spiraling axially therealong from a vertical edge 42. The annular or circular peripheral edge 40 spirals axially with offset terminal ends thereof connected by the vertical edge 42 which extends parallel to the axis of the tubular member 12 defining an axially stepped portion. This peripheral edge and vertical edge 42 cooperate with a similar peripheral edge on the cap member 14 for defining the variable angle or arc and variable volume orifice of the present sprinkler unit.

A plurality of inwardly extending spaced ribs 44 extend along parallel the axis along the interior of the wall 28 of the tubular member 12 for cooperatively defining, in conjunction with the screw 16, water flow passages as well as providing mounting support for the screw 16.

The cap 14 defines a generally slightly cupped or dished radial flange member having a peripheral sloped surface 15 and a downwardly depending generally cylindrical skirt member 48. The skirt 48 terminates at the lower end by a peripheral edge 50 spiraling axially along the axis of the cylindrical skirt 48 to a vertical connecting or termination edge 52 which extends parallel to the axis of the skirt thereby defining an axially stepped circular edge. This peripheral edge cooperates with the first described peripheral edge 40 of the member 12 for defining the outlet orifice or aperture of the sprinkler unit. An interior skirt 54 defines a cylindrical bore for rotatably engaging the cylindrical surface of the screw member 16. The peripheral edges 40 and 50 spiral in the same axial direction with the same pitch.

The screw member 16 is defined by an elongated generally cylindrical shank portion or member 58 having threads 60 extending along the length thereof for threadably engaging the interior ribs 44 of the tubular member 12. The screw threads 60 have the same pitch as the peripheral edges 40 and 50. The screw includes a radially extending disc-like head or cap portion 62 in which is provided a suitable driving slot 64 for receiving a screwdriver or like instrument for rotation of the screw. The screw 16 holds the cap 14 and inner tubular member 12 together and upon rotation with cap 14 adjusts the arc of coverage. Rotation of the screw 16 only while holding the cap fixed adjusts the height of the orifice opening.

Figure 5:
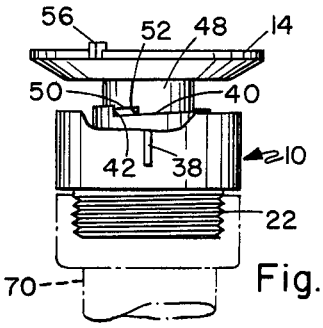
FIG. 5 is a side elevation view on a reduced scale showing the spray opening reduced.

The above-described construction provides an arrangement which can be constructed such that the components thereof may be made by the injection molding process and components thereof easily assembled as shown in FIG. 2 to provide the assembled sprinkler unit as illustrated in FIG. 5 which may then be attached to a source of a supply of water. This provides a simple and convenient construction which can be fabricated as explained by the injection molding process. It is apparent that the number of components can be reduced, it being understood that the essential features are the tubular body member defining the peripheral edge with the coaxially disposed rotatable member defining a cooperating peripheral edge which edges together define a variable angle orifice with means for adjusting the height of the orifice for adjusting the volume of flow therefrom.

In operation the above described components are selected and fit together in the manner as shown in FIG. 1 with the tubular member 12 fitting within the bore within the housing member 10 with the outer surface of the wall 28 thereof being engaged and supported by the internally directed ribs 26 on the interior of wall 20 of the housing 10. The tubular member 12 extends into the bore with the radial flange 30 oriented such that locating lugs 34 align with locating slot 36 and the radial lugs 32 selectively fit within grooves between internal ribs 24 for proper angular orientation relative to the housing 10 with flange 30 engaging shoulder 25 of the stepped bore of the mounting housing 10.

A cap 14 is selected and positioned at the outlet end of the tubular member 12 such that the downwardly depending skirt 48 of the cap extends within the bore of the cylindrical wall 20 of tubular member 12 with the peripheral edges 40 and 50 and vertical edges 42 and 52 of the tubular member 12 and cap 14 respectively cooperating to define an annular variable length and variable height orifice. The screw 16 is inserted through the bore of the cap 14 and engages threads formed on the inner edges of the interior ribs 44 within the tubular member 12 and serves to adjustably hold the caps 14 into position axially relative to the tubular member 12 as well as provide means for selectively adjusting the relative axial position thereof for adjusting the height of the aperture or orifice. The cap 14 is biased to the uppermost position by water pressure within the sprinkler unit.

The ribs 44 provide support for the screw body member 58 and together therewith define water flow passages 68 along the length of the tubular body member 12 communicating with the annular orifice defined by the peripheral edges 40 and 50.

Figure 3:
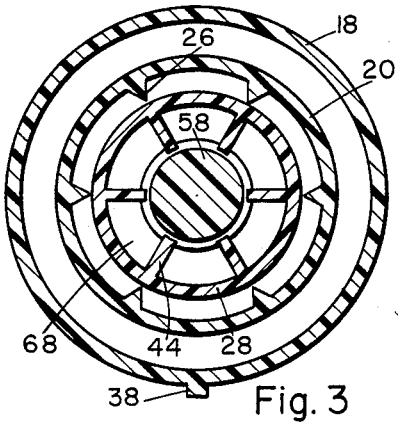
FIG. 3 is a detailed view taken on line 3—3 of FIG. 2.
Figure 4:
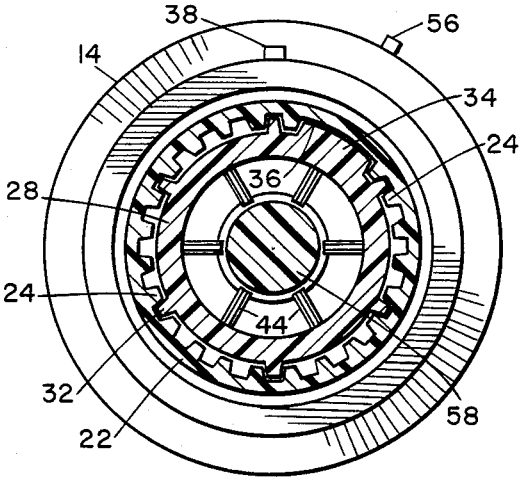
FIG. 4 is a sectional view taken on line 4—4 of FIG. 2.

The internally directed ribs 26 as shown in FIG. 3 support the tubular body member 12 within the bore of the housing member 10 and provide a minimum contact between the surfaces thereof to permit free movement up and down of the tubular member 12 as water pressure goes on and off reducing the prospect of binding therein. When water is turned on, the water pressure forces the cap 14 and sleeve 12 upward to the uppermost position as shown in FIGS. 2 and 5. When water is shut off, the cap 14 and sleeve 12 drop down so that the peripheral surface 15 of the cap 14 engages peripheral edge 19. This closes the chamber formed by the housing 10 preventing water from vaporizing from the orifice. This prevents precipitation of salt and other mineral deposits on the orifice from the evaporating water.

Once an assembled sprinkler unit mounted on a source of water supply such as a riser 70 as shown in FIG. 5, the orifice angle indicators 38 and 56 are appropriately positioned by rotation of the cap member 14 and screw 16 to provide the desired opening of the orifice. Thus the cap 14 may be selectively rotated with the screw 16 from a position of essentially no orifice opening where edges 42 and 52 are together to a position of an orifice opening of 360 degrees. When the height (vertical opening) of the orifice is to be adjusted without changing the arc, the cap 14 is held and screw 16 is rotated.

Thus from the above description it is apparent that I have provided an improved sprinkler unit having a variable opening orifice from approximately 0 to 360 degrees such that a single sprinkler unit may be selectively provided for covering any selected angle of coverage. In addition the orifice opening can be varied in height to provide a selected volume of flow for a selected angle of coverage.

While I have illustrated and described my invention by means of specific embodiments, it is to be understood that numerous changes and modifications may be made therein without departing from the spirit and scope of the invention as defined in the appended claims.

What is claimed is:

1. An adjustable orifice sprinkler unit, comprising:

a tubular body member having an inlet means for attachment to a source of pressurized water and an outlet end surrounded by a first circular peripheral edge having axially offset ends; and a rotatable member mounted on said outlet end of said tubular body member and including means defining a second circular peripheral edge having axially offset ends, and positioned coaxially adjacent to and cooperating with said first circular peripheral edge for defining an adjustable width arcuate outlet orifice that is adjustable in width upon rotation of said rotatable member relative to said tubular body member.

2. A sprinkler unit according to claim 1 wherein said rotatable member is mounted co-axial of said tubular body member and includes an axially extending skirt defining said second peripheral edge and at least partially overlapping said first peripheral edge.

3. An adjustable orifice sprinkler unit, comprising:

a tubular body member having an inlet means for attachment to a source of pressurized water and an outlet end surrounded by a first circular peripheral edge having an axially stepped portion;

a rotatable member mounted coaxial of and on said outlet end of said tubular body member and including an axially extending skirt defining a second circular peripheral edge having an axially stepped portion for at least partially overlapping and cooperating with said first circular peripheral edge for defining an adjustable width arcuate outlet orifice that is adjustable in width upon rotation of said rotatable member relative to said tubular body member; and wherein said first circular peripheral edge and said second circular peripheral edge each spiral axially and each have an offset end connected by a vertical edge defining said axially stepped portion.

4. The sprinkler unit of claim 3 including means for moving said rotatable member axially relative to said tubular body member for adjusting the height of said orifice.

5. The sprinkler unit of claim 4 wherein said means for moving said rotatable member comprises a screw threadably mounted in said tubular body member, and securing said rotatable member to said body member.

6. The sprinkler unit of claim 5 comprising a sleeve mounted in said tubular body member, and said screw threadably engages said sleeve.

7. The sprinkler unit of claim 6 wherein said sleeve includes a plurality of radially inwardly ribs, said screw threadably engages said ribs along an inward edge thereof, and said ribs and said screw define water flow passages between said inlet means and said outlet end.

8. An adjustable orifice sprinkler unit, comprising:

a tubular body member having an inlet means for attachment to a source of pressurized water and an outlet end surrounded by a first circular peripheral edge having an axially stepped portion;

a rotatable member mounted on said outlet end of said tubular body member and including means defining a second circular peripheral edge having an axially stepped portion positioned coaxially adjacent to and cooperating with said first circular peripheral edge for defining an adjustable width upon rotation of said rotatable member relative to said tubular body member; and wherein said circular peripheral edges defining said outlet orifice are defined by annular spirals having offset ends connected by an edge.

9. An adjustable orifice sprinkler unit, comprising:

a tubular body member having an inlet means for attachment to a source of pressurized water and an outlet end surrounded by a first continuous circular peripheral edge having an axially stepped portion;

a rotatable member mounted on said outlet end of said tubular body member and including means defining a second circular peripheral edge having an axially stepped portion positioned coaxially adjacent to and cooperating with said first circular peripheral edge for defining an adjustable width arcuate outlet orifice that is adjustable in width upon rotation of said rotatable member relative to said tubular body member; and wherein the outlet orifice is adjustable from about 0 degrees to about 360 degrees about the axis of said tubular body member.

10. An adjustable orifice sprinkler unit, comprising:

fixed housing means defining a passage having an inlet for attachment to a source of pressurized water and an outlet defined by a first circular edge having axially offset ends for dispensing water; and moveable housing means mounted on said fixed housing means and including means defining a second circular edge having axailly offset ends cooperative with said first circular edge of said fixed housing means for defining an adjustable angle dispensing orifice adjustable about the axis of said outlet.

11. The sprinkler unit of claim 10 wherein said dispensing orifice is a slit defined between said fixed housing means and said moveable housing means.

12. The sprinkler unit of claim 11 wherein said moveable housing means is rotatable about the axis of said outlet for adjusting the length of said slit, and said moveable housing means is moveable axially of said outlet for adjusting the width of said slit.

13. The sprinkler unit of claim 12 wherein said moveable housing means is rotatably mounted on axially moveable screw means mounted in said fixed housing means.

14. The sprinkler unit of claim 10 comprising chamber means for enclosing said outlet orifice during non-operation.

15. The sprinkler unit of claim 14 wherein said chamber means comprises an outer cylindrical wall surrounding said first peripheral edge and said second peripheral edge, and cap means mounted to move axially of said cylindrical wall and cooperative therewith for defining and closing said chamber means.

16. The sprinkler unit of claim 10 comprising chamber means for enclosing said orifice during non-operation.

17. The sprinkler unit of claim 16 wherein said chamber means comprising:

an outer cylindrical wall surrounding said dispensing orifice and having an open end, and a radial flange on said moveable housing means for engaging said open end of said outer cylindrical wall for closing said chamber means.

18. An adjustable orifice sprinkler apparatus, comprising:

a tubular member having an inlet end and an outlet end and a passage communicating therebetween, said outlet end defined by a spiral edge having offset ends connected by a generally straight edge;

a cap member rotatably mounted on the outlet end of said tubular member and having a tubular skirt coaxial of said tubular member, said skirt terminating in a spiral edge having offset ends connected by a generally straight edge; and, screw means for rotatably mounting said cap member coaxially of said tubular member, with said spiral edges and said straight edges in opposed cooperative relationship for defining a variable width and variable height orifice, said cap member being rotatable for varying said orifice from about zero to about three hundred and sixty degrees, and said cap member being moveable axially of said tubular member by rotation of said screw member for varying the height of said orifice.

* * * * *